US008986829B2

(12) United States Patent
Akedo

(10) Patent No.: US 8,986,829 B2
(45) Date of Patent: Mar. 24, 2015

(54) LAYERED BODY

(75) Inventor: Jun Akedo, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 598 days.

(21) Appl. No.: 11/651,306

(22) Filed: Jan. 9, 2007

(65) Prior Publication Data

US 2007/0202322 A1 Aug. 30, 2007

Related U.S. Application Data

(63) Continuation-in-part of application No. 10/968,746, filed on Oct. 19, 2004, now abandoned, which is a continuation of application No. 09/752,360, filed on Dec. 29, 2000, now Pat. No. 6,827,634.

(30) Foreign Application Priority Data

May 22, 2000 (JP) ..... 2000-150341

(51) Int. Cl.

| | |
|---|---|
| ***G11B 11/105*** | (2006.01) |
| ***A01K 1/015*** | (2006.01) |
| ***B32B 9/00*** | (2006.01) |
| ***B32B 19/00*** | (2006.01) |
| ***B05D 1/02*** | (2006.01) |
| ***B05D 1/36*** | (2006.01) |
| ***B05D 5/00*** | (2006.01) |
| ***C23C 24/04*** | (2006.01) |
| ***C23C 4/18*** | (2006.01) |
| ***C23C 26/00*** | (2006.01) |
| ***C23C 30/00*** | (2006.01) |

(52) U.S. Cl.
CPC . *C23C 24/04* (2013.01); *C23C 4/18* (2013.01); *C23C 26/00* (2013.01); *C23C 30/00* (2013.01)
USPC ..... 428/332; 428/221; 428/699; 428/701; 427/193; 427/202; 427/427

(58) Field of Classification Search
USPC ..... 428/698, 221, 332, 699, 701; 427/193, 427/202, 427
See application file for complete search history.

(56) References Cited

U.S. PATENT DOCUMENTS

| | | | | |
|---|---|---|---|---|
| 5,302,414 | A * | 4/1994 | Alkhimov et al. | 427/192 |
| 5,452,178 | A * | 9/1995 | Emesh et al. | 361/303 |
| 5,507,898 | A * | 4/1996 | Aoki et al. | 156/89.14 |
| 6,531,187 | B2 * | 3/2003 | Akedo | 427/475 |

FOREIGN PATENT DOCUMENTS

RU 2038411 * 6/1995 ..... C23C 4/00

OTHER PUBLICATIONS

Akedo et al. "Microstructures and Electrical properties of Lead Zirconate Titanate (Pb(Zr52/Ti48)O3) Thick Films Deposited by Aerosol Deposition Method", Japanese Journal of Applied Physics, vol. 38, Pt. 1, No. 9B, Sep. 1999, pp. 5397-5401.*
Hwang et al. "The leakage current mechanism of PZT thin films deposited by insitu sputtering" Journal of Materials Science Letters, vol. 15, 1996, pp. 1030-1031.*

(Continued)

*Primary Examiner* — Jonathan Langman
(74) *Attorney, Agent, or Firm* — Lucas & Mercanti LLP

(57) ABSTRACT

A planarized fine particle layered body which has fine particles sufficiently bonded together, sufficient density, flat surface and uniform density from a deposition of fine particles formed by supplying the fine particles to a substrate by aerosol deposition method.

2 Claims, 16 Drawing Sheets

(56) References Cited

OTHER PUBLICATIONS

English Translation of Buzdygar et al. Russian patent No. 2038411, Jun. 1995. Translation retrieved from U.S. Appl. No. 10/312,154.*
Akedo et al. "Powder Preparation in Aerosol Deposition Method for Lead Zirconate Titanate Thick Films", Jpn. J. Appl. Phys., vol. 41, 2002, pp. 6980-6984.*
Akedo, "Aerosol Deposition Method for Fabrication of Nano Crystal Ceramic Layer", Materials Science Forum, vols. 449-452, 2004, pp. 43-48.*
National Institute of Advanced Industrial Science and Technology (AIST), Developmen T of the Measurement Apparatus for Fine Particle Strength, Press Release of Oct. 26, 2005.

* cited by examiner

FIG. 7A
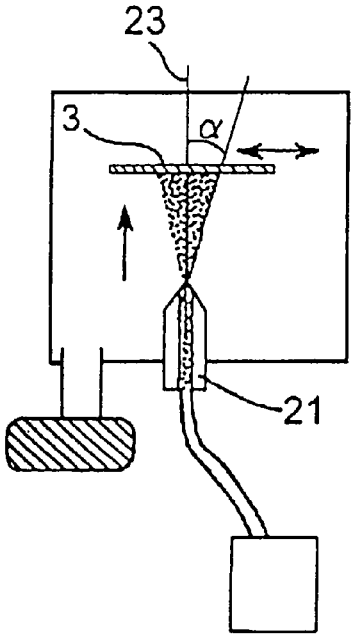
FIG.7B
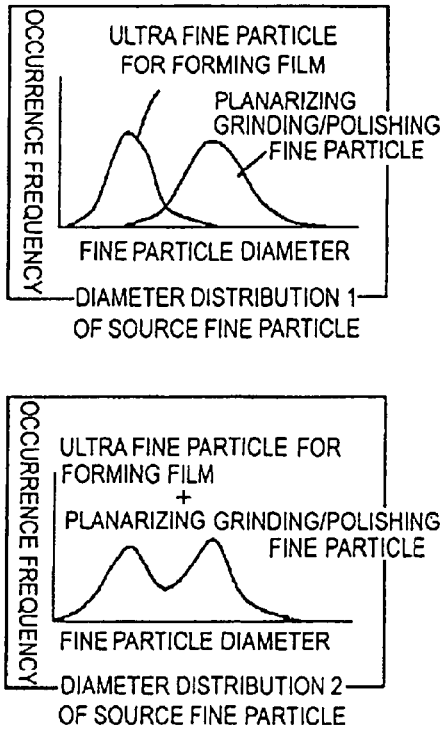
FIG. 7C (a) OBSTRUCTION OF ATTACHED FINE PARTICLES AGAINST NORMAL DEPOSITION (b) ABRASION OF DEPOSIT SURFACE BY FINE PARTICLES

LAYERED BODY

RELATED APPLICATION

This application is a continuation-in-part of my application Ser. No. 10/968,746 filed Oct. 19, 2004 (continuation of Ser. No. 09/752,360 filed Dec. 29, 2000 now U.S. Pat. No. 6,827,634)

BACKGROUND OF THE INVENTION a) Field of the Invention

The present invention relates to techniques of supplying ultra fine particles of ceramic, metal and the like not larger than about 1 μm to a substrate to form a ultra fine particle film. Such techniques of forming a ultra fine particle film are applied to the technical fields of forming a functional ceramic thin film, a metal thin film or the like on a substrate.

b) Description of the Related Art

As one of techniques of forming a ultra fine particle film, it is known to mix ultra fine particles with transport gas and spray the particles mixed with the transport gas from a nozzle toward a substrate surface to form a ultra fine particle film.

This conventional ultra fine particle film forming method is, however, associated with some problems that the film surface is not smooth and flat and the density of the film is not uniform. Specifically, with the conventional ultra fine particle film forming method, if ultra fine particles contain defective particles (such as particles having a diameter of 1 μm or larger and insufficiently accelerated particles) unable to physically form a film, these defective particles are mixed in a deposit on a substrate.

More specifically, if ultra fine particles jetted out during a film deposition contain a particle (defective particle) 31 having a large particle diameter or an insufficient speed, as shown in a schematic diagram of FIG. 9 A and a microscopic photograph shown in FIG. 10A, the large diameter defective particle 31 attaches to and sinks in the surface layer of a deposit 32 under growth, and this defective particle 31 functions as a mask so that deposition does not occur thereafter on the surface of this defective particle 31. As shown in FIGS. 9 A and 10 B, the film 33 after cleaning has a depression 34. As shown in a microscopic photograph of FIG. 11, the film surface is very rough, which adversely affects later deposition. Since the defective particle is in a floating state in the deposit 32, the film is not dense and the surface of the deposit is abraded by ultra fine particles to be later blown toward the surfaces. Also in this case, as shown in FIG. 9B, the films 33 has a depression 34 and the film surface is very rough, which adversely affects later deposition. If such a conventional film forming method is applied to forming a ceramic electronic component which is required to have a homogeneously controlled fine structure of the film, excellent electrical characteristics cannot be expected.

It is also practically difficult to make the amount of fine particles to be jetted out of a nozzle uniform and constant, so that the film thickness changes at positions. It is also difficult to control a film thickness and a surface uniformity, which becomes a large obstacle against forming films having uniform performance and good film quality. Such irregular film thickness and surface roughness become a critical issue when the conventional method is applied to forming an optical thin film.

It has been desired to provide techniques of forming a ultra fine particle film which has ultra fine particles sufficiently bonded together, sufficient density, flat surface and uniform density.

SUMMARY OF THE INVENTION

The invention has been made under such circumstances. It is an object of the present invention to provide a layered body which has ultra fine particles sufficiently bonded together, sufficient density, and particularly flat surface and uniform density and a ultra fine particle film forming apparatus capable of forming a ultra fine particle film which has ultra fine particles sufficiently bonded together, sufficient density, and particularly flat surface and uniform density.

In order to achieve the above object of the invention, there is provided a layered body comprises a substrate and a compact brittle material layer deposited on the substrate, wherein said compact brittle material layer is provided plastically deformable particles.

According to another aspect of the invention, there is provided a layered body comprises a substrate and a compact brittle material layer deposited on the substrate and having smooth surface on its front side, wherein said compact brittle material layer is provided plastically deformable particles.

According to another aspect of the invention, there is provided a layered body comprises a substrate, and compact brittle material layers, wherein one compact brittle material layer is deposited on the substrate and having smooth surface on its front side, and other compact brittle material layer is deposited on smooth surface of said front side of one compact brittle material layer, wherein said one and other compact brittle material layers is provided plastically deformable particles.

According to another aspect of the invention, there is provided a layered body comprises a substrate, a compact brittle material layer deposited on said substrate and having smooth surface on its front side, wherein said compact brittle material layer is provided plastically deformable particles, and metal material layer deposited on smooth surface of said front side of the compact brittle material layer.

According to another aspect of the invention, there is provided a layered body comprises a substrate, and a compact brittle material layer deposited on said substrate and having smooth surface on its front side of the compact brittle material layer.

According to another aspect of the invention, there is provided a layered body comprises a substrate, and a compact brittle material layer deposited on said substrate and having smooth surface on its front side and a metal material layer deposited on the front side of the compact brittle material layer.

According to another aspect of the invention, there is provided a layered body comprises a substrate and a compact brittle material layer, wherein said compact brittle material layer is deposited on said substrate and provided plastically deformable particles, and said particle is provided an anchor part in the substrate.

According to another aspect of the invention, there is provided a planarized ultra fine particle film forming method for forming a planarized ultra fine particle film from a deposited film of ultrafine particles formed by supplying the ultra fine particles to a substrate, the method comprising one or more of a planarizing step of planarizing a surface of the deposited film of the ultra fine particles supplied to the substrate, According to another aspect of the invention, there is provided a planarized ultra fine particle film forming apparatus for forming a planarized ultra fine particle film from a deposited film of ultra fine particles formed by supplying the ultra fine particles to a substrate, the apparatus comprising at least one of: an attached particle removal apparatus for rolling or scraping a surface layer portion of the deposited film of the ultra fine particles supplied to the substrate; a film surface processing apparatus for grinding or polishing the surface layer portion; and a pressure apparatus for pressing the deposited film.

According to another aspect of the invention, there is provided a planarized ultra fine particle film forming method for forming a planarized ultra fine particle film from a deposited film of ultra fine particles formed by supplying the ultra fine particles to a substrate, the method comprising one or more of a planarizing step of planarizing a surface of the deposited film of the ultra fine particles by blowing planarizing fine particles having a grinding/polishing function at an oblique incidence angle toward the surface of the deposited film.

According to another aspect of the invention, there is provided a planarized ultra fine particle film forming apparatus for forming a planarized ultra fine particle film from a deposited film of ultra fine particles formed by supplying the ultra fine particles to a substrate, wherein planarizing fine particles having a grinding/polishing function are blown at an oblique incidence angle toward the surface of the deposited film.

BRIEF DESCRIPTION OF THE DRAWINGS

FIG. 7 A is a schematic diagram showing another example of a spray apparatus for blowing ultra fine particles and planarizing particles, and FIGS. 7B and 7 C are graphs showing a diameter distribution of planarizing fine particles and ultra fine particles.

FIG. 16(*b*) is a scanning electron microscope (SEM) photograph and X-ray diffraction photograph of particle at position i, j, k and l.

DETAILED DESCRIPTION OF THE PREFERRED EMBODIMENTS

Embodiments of the invention will be described with reference to the accompanying drawings.

The most important feature of the present invention is to relate to layered body formed by aero-sol deposition method. The layer body comprises plastically deformable particles.

Example 1

Figure 12:
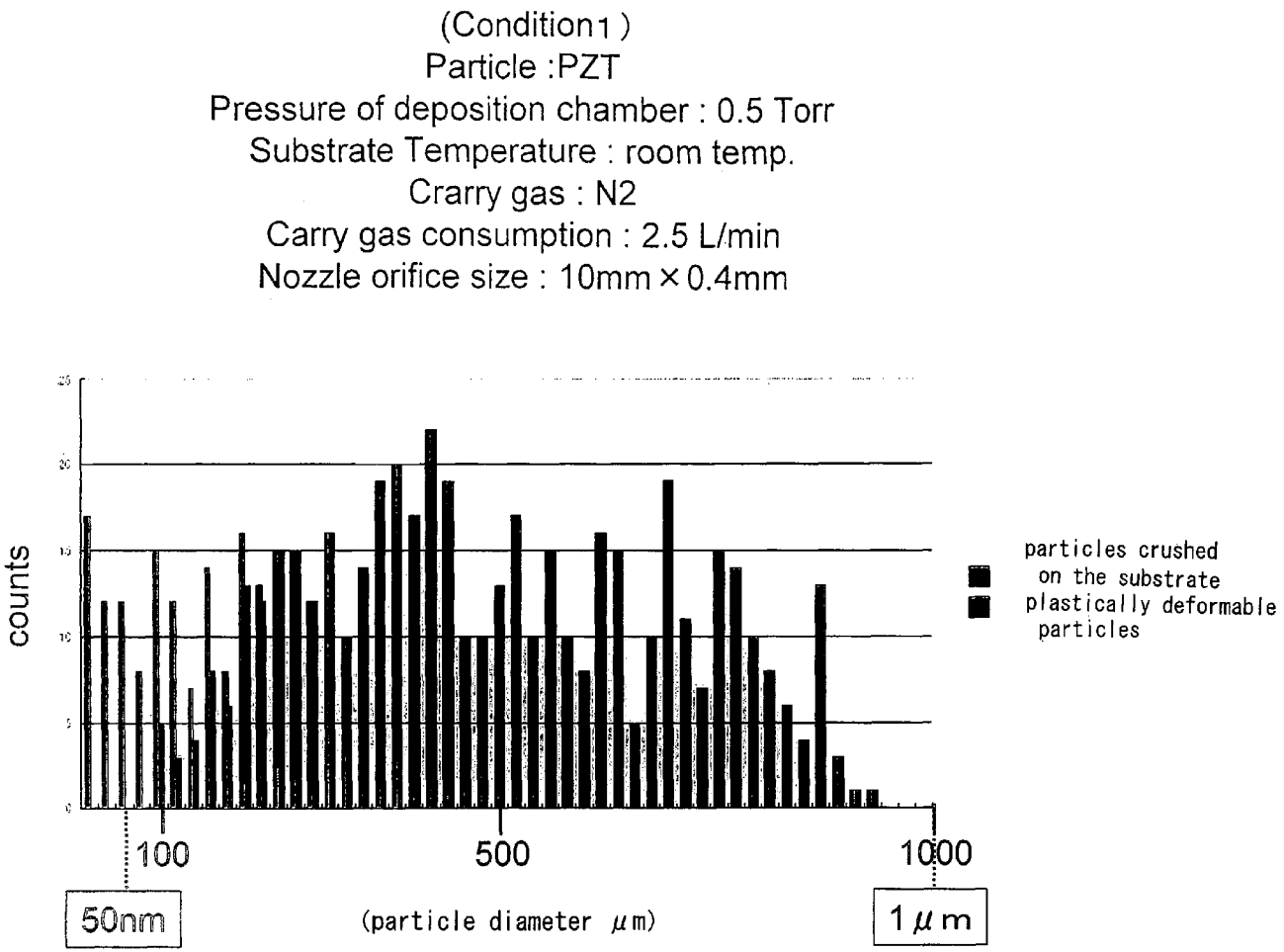
FIG. 12 is a graph showing a diameter and count of PZT particles which are sprayed from the nozzle (input particles) and plastically deformed on the substrate.

Condition;
Particle; PZT
Pressure of deposition chamber; 0.5 Torr
Temperature: room temp.
Carry gas; N2
Carry gas consumption; 2.5 L/min
Nozzle orifice size; 10 mm×0.4 mm
Impact pressure; more than compressive strength (Fc); 0.2 Gpa~5 Gpa of particle
Velocity; 150 m/s~400 m/s FIG. 12 shows a diameters and count of PZT particles which are collided with the substrate, and plastically deformed on the substrate. It is understandable from this figure that the range of diameter of particles for causing plastically deformation on substrate is 50 nm~1.0 μm.

Example 2

Figure 13:
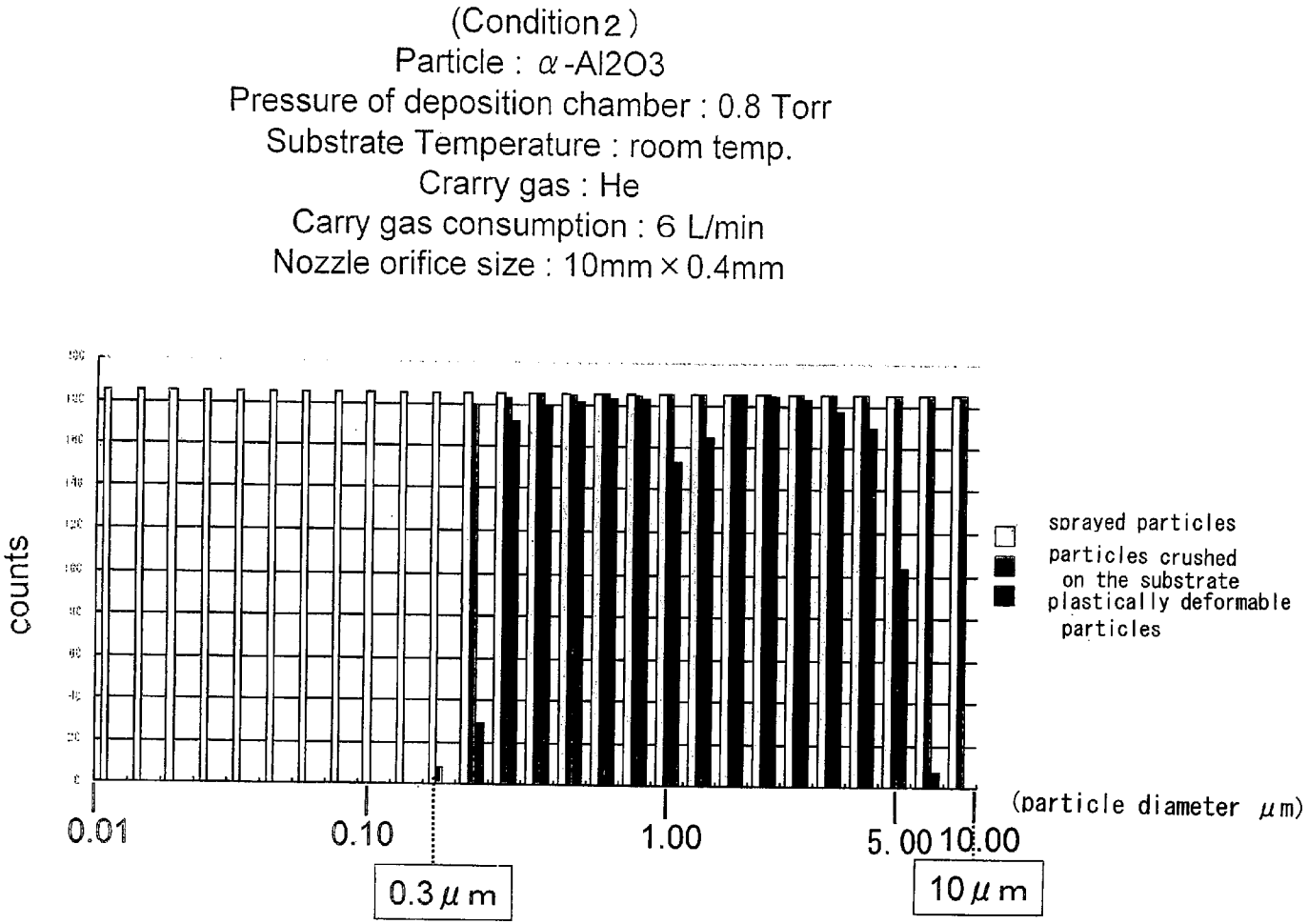
FIG. 13 is a graph showing a diameter and count of $\alpha$-$Al_2O_3$ particles which are sprayed from the nozzle (input particles), collided with the substrate and plastically deformed on the substrate.

Condition;
Particle; $\alpha$-$Al_2O_3$
Pressure of deposition chamber; 0.8 Torr
Temperature: room temp.
Carry gas; He
Carry gas consumption; 6 L/min
Nozzle orifice size; 10 mm×0.4 mm
Impact pressure; more than compressive strength (Fc); 2 Gpa~20 Gpa of particle
Velocity; 150 m/s~600 m/s FIG. 13 shows a diameters and count of $\alpha$-$Al_2O_3$ particles which are sprayed from the nozzle (input particles), collided with the substrate and plastically deformed on the substrate. It is understandable from this figure that the range of diameter of particles for causing plastically deformation on substrate is 0.3 μm~10 μm.

Also, it is understandable from this figure that in diameter range of 5 μm~10 μm, ratio of count of particle plastically deformed on substrate to particles collided with substrate is decreasing. Therefore, the diameter range of particle plastically deformed on substrate is preferably 50 nm~5 μm, The range of diameter of particle for causing plastically deformation on the substrate is applicable to insulating oxide materials such as $\alpha$-$Al_2O_3$, ferroelectric oxide materials such as PZT, BTO, ferromagnetic oxide materials such as PZT, BTO, nitride materials such as AlN, boride materials, fluoride materials.

Figure 14:
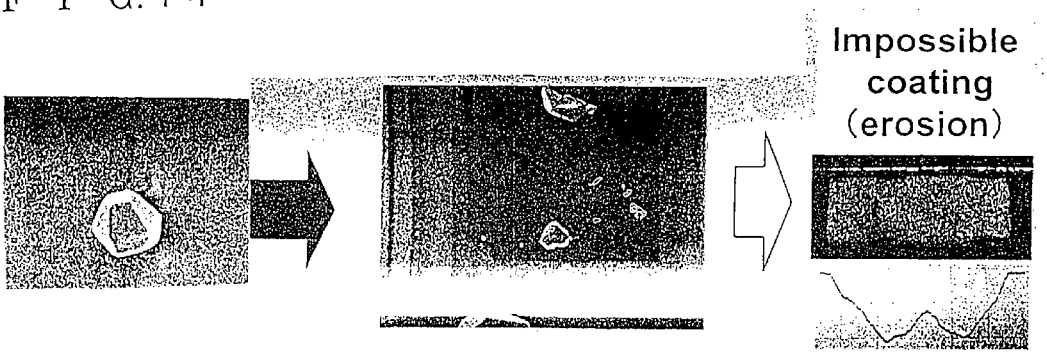
FIG. 14 is a scanning electron microscope (SEM) photograph showing the particle of larger than 10 μm of the plastically deformed particle.

The upper limit of size of particle for causing plastically deformation on substrate will be understood from description of FIG. 14.

FIG. 14 is scanning electron microscope (SEM) photograph showing that in case the diameter of particle collided with substrate is larger than 10 μm, the particle is crushed by collide on the substrate and the crushed small size particle is scattered. The scattered particle can not deposit on the substrate and therefore can not contribute the compact formation of the layered body on the substrate. It functions to etch substrate as if it is sandblast.

Figure 15:
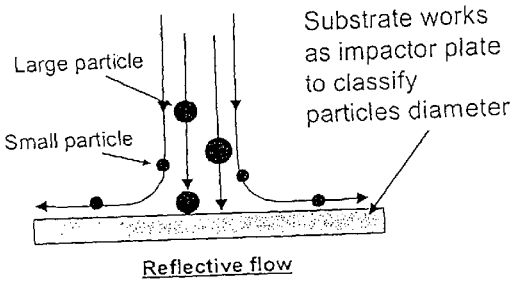
FIG. 15 is a schematic diagram showing the flow of particles.

Meanwhile, the lower limit of size of particle for causing plastically deformation on substrate will be understood from description of FIG. 15. In FIG. 15, when particle sprayed from the nozzle is smaller than 50 nm, the particle is conveyed with flow of carry gas or the particles will not collide on the substrate with enough energy, the particle can not plastically deform on the substrate. Therefore, the particle can not contribute the compact formation of layered body on the substrate.

Therefore, when the particles blown from nozzle will be collided for the substrate with enough energy, the particle of diameter of 50 nm~10 μm preferably 50 nm~5 μm within the diameter of the collided particle is plastically deformed on substrate. Then, a pressure of deposition chamber is under pressure reduction, preferably less than 20 Torr, more preferably less than 5 Torr.

Figure 16:
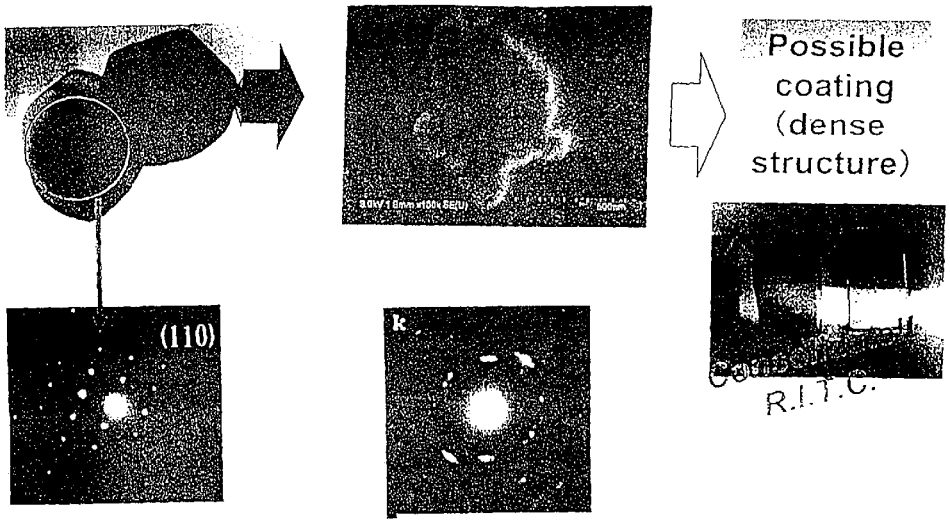
FIG. 16(*a*) is a scanning electron microscope (SEM) photograph and X-ray diffraction photograph showing ceramic material whose particle diameter is 0.7 μm of before and after compression.
Figure 16B:
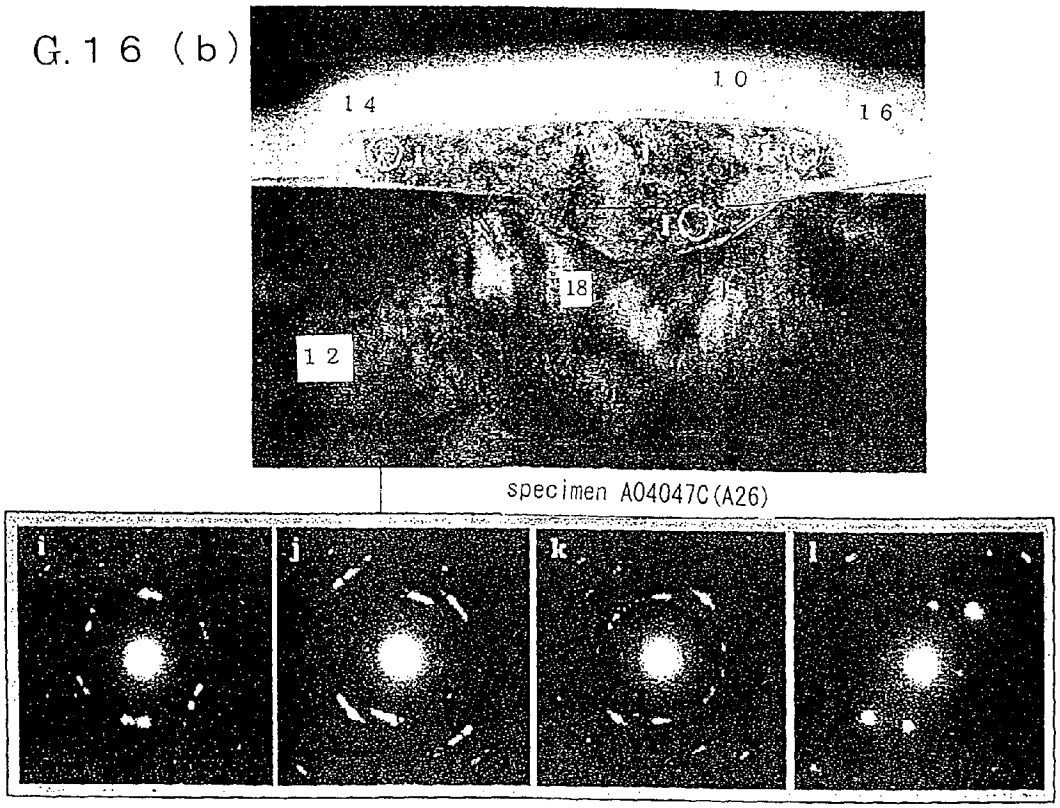

FIG. 16(*a*) is scanning electron microscope (SEM) photograph and X-ray diffraction photograph showing particle with diameter; 0.4 μm plastically deformed on substrate. Wherein it is understandable that though the particle before compression is single crystalline from X-ray diffraction photograph, the particle after compression is provided polycrystalline. Therefore, the plastically deformed particles on substrate will form the possible coating with a dense structure.

FIG. 16(*b*) is an enlarged scanning electron microscope (SEM) photograph and X-ray diffraction photograph showing the plastically deformed particle shown at FIG. 16(*a*). In this figure, X-ray diffraction photograph of the plastically deformed particle at position i, j, k and l are shown and it is understandable that the particle is provided polycrystalline. The polycrystalline contains single crystalline with diameter of less than 30 nm.

And, the plastically deformable particles are deposited in order. Therefore, the gaps between plastically deformed particles are packed to form a compact particles assembly. Furthermore, because active surface is created on the surface of particle by transposition of displacement or dislocation in crystalline plane by plastically deformation, the active surface is caused to re-bonded with following collided particle.

To form compact layered body by causing easy and tight re-bonding of the particle, it is desired to compose polycrystalline comprising the single crystalline with diameter of less than 30 nm. Thus in case that the polycrystalline is provided in diameter of less than 30 nm by transposition of displacement or dislocation of crystalline plane, activity in surface of particles is enhanced and particles are re-bonded easily and tightly each other.

In FIG. 16(*b*), it is understandable that the particles are fixed tightly to the substrate and plastically deformed on the substrate, that is, the plastically deformed particles 10 deposited on the substrate 12 has the plastically deformed part 14, 15 on the both side of the particle 10 and the anchor part 18 is fixed rigidly to the substrate 12.

A layered body comprises a substrate and a compact brittle material layer deposited on the substrate, wherein said compact brittle material layer is provided plastically deformable particles.

A layered body comprises a substrate and a compact brittle material layer deposited on the substrate and having smooth surface on its front side, wherein said compact brittle material layer is provided plastically deformable particles.

A layered body comprises a substrate, and compact brittle material layers, wherein one compact brittle material layer is deposited on the substrate and having smooth surface on its front side, and other compact brittle material layer is deposited on smooth surface of said front side of one compact brittle material layer, wherein said one and other compact brittle material layers is provided plastically deformable particles.

A layered body comprises a substrate, a compact brittle material layer deposited on said substrate and having smooth surface on its front side, wherein said compact brittle material layer is provided plastically deformable particles, and metal material layer deposited on smooth surface of said front side of the compact brittle material layer.

A layered body comprises a substrate, and a compact brittle material layer deposited on said substrate and having smooth surface on its front side of the compact brittle material layer.

A layered body comprises a substrate, and a compact brittle material layer deposited on said substrate and having smooth surface on its front side and a metal material layer deposited on the front side of the compact brittle material layer.

A layered body comprises a substrate and a compact brittle material layer, wherein said compact brittle material layer is deposited on said substrate and provided plastically deformable particles, and said particle is provided an anchor part in the substrate.

Planarized ultra fine particle film forming apparatus and method described hereinafter are usable to form layered body of the present invention.

Figure 1:
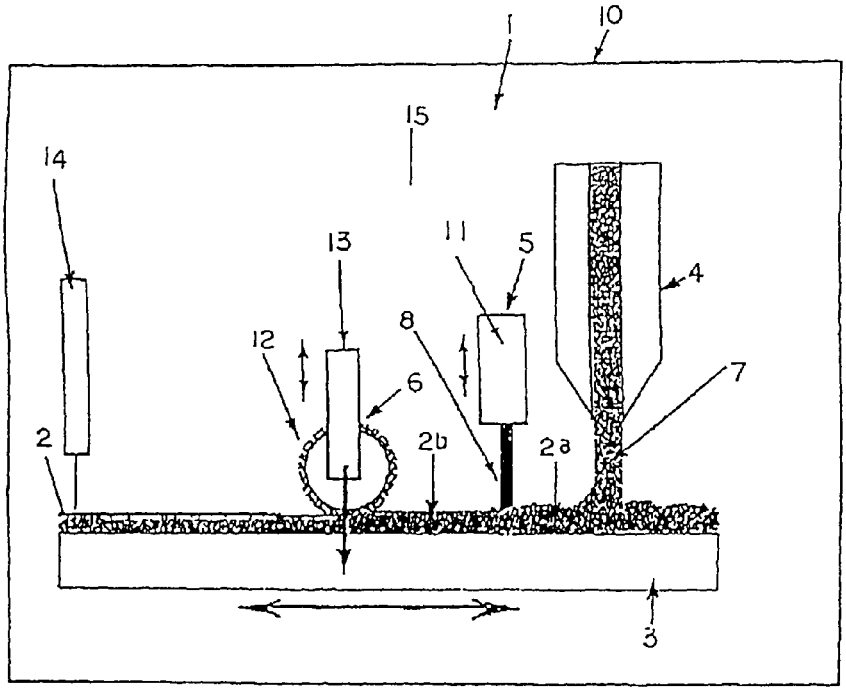
FIG. 1 is a schematic diagram showing the structure of a planarized ultra fine particle film forming apparatus according to an embodiment of the invention.

In FIG. 1, reference numeral 1 represents a planarized ultra fine particle film forming apparatus. The planarized ultra fine particle film forming apparatus 1 has a substrate 3 and a nozzle 4 disposed in a chamber 10. The nozzle 4 is an example of a ultra fine particle supply apparatus. The substrate 3 is used for supporting a film to be formed thereon. An attached fine particle removal apparatus 5 and a film surface processing apparatus 6 are disposed along a substrate motion path. The attached fine particle removal apparatus 5 and film surface processing apparatus 6 constitute a planarizing apparatus 15 for processing a deposited film 2*a*. The chamber 10 may be a vacuum chamber capable of reducing the inner pressure. If the vacuum chamber is used as the chamber 10, the vacuum degree is set to about 10 to 200 Torr, or preferably to about 100 torr.

The nozzle 4 is used for supplying ultra fine particles to the substrate 3 to form a deposited film 2*a*. The substrate 3 is mounted on a substrate drive apparatus (not shown) so that it can be driven movably in the chamber. The nozzle 4 may be set so that it can also be driven movably in the chamber. Instead of jetting out transport gas and ultra fine particles from the nozzle 4 to the substrate 3, other method may be used depending upon the type or other conditions of ultra fine particles, such as flowing ultra fine particles out of a slit upon application of fine vibrations. The attached particle removal apparatus 5 scrapes the surface of the deposited film 2*a* of ultra fine particles 7 supplied to the substrate 3 to planarize the surface and remove defective particles: including ultra fine particles having a large diameter and protruding from the planarized surface and ultra fine particles attached on the planarized surface. The attached particle removal apparatus 5 has an attached particle removal blade 8 and a gap control mechanism 11. The attached particle remove blade 8 is made of hard rubber or a metal plate and is disposed near the nozzle 4. During the motion relative to the substrate 3, the attached particle removal apparatus 5 scrapes the surface of the deposited film 2*a* of ultra fine particles supplied from the nozzle 4 to the substrate 3 to remove defective particles such as embedded large diameter ultra fine particles and attached ultra fine particles and form a scraped film 2*b*. The scrape amount of the surface of the deposited film 2 *a* by the attached particle removal blade 8 can be adjusted by controlling a gap between the attached particle removal blade 8 and substrate 3. This adjustment is performed by operating the gap control mechanism 11 to drive the attached particle removal blade 8.

The scraped film 2*b* formed by scraping a predetermined amount of the surface layer with the attached particle removal blade 8 is then processed by a film surface processing apparatus 6. The film surface processing apparatus 6 has a grinding/polishing roller 12 and a gap control mechanism 13. The grinding/polishing roller 12 is made of a polishing brush or a roller made of polishing material. The grinding/polishing roller 12 is rotated at a speed matching the substrate scan speed and made in contact with the surface scraped film 2*b* to grind and polish it to adjust the film thickness and form a final film 2. In this case, the film thickness before and after the grinding/polishing is measured by using a displacement gauge 14 such as an optical displacement is gauge and an air micro displacement gauge. In accordance with the measured film thickness, the gap between the surface of the deposited film 2*a* and surface scraped film 2*b* and the grinding/polishing roller 12 and attached particle removal blade 8 is controlled. Adjustment of the gap and pressure is performed by using the gap control mechanisms 11 and 13.

In this embodiment, the deposited film 2*a* of ultra fine particles 7 supplied to the substrate 3 is processed twice, first by the attached particle removal apparatus 5 to form the surface scraped film 2*b* and then by the film surface processing apparatus to form a final film 2. If a film having the same property as the final film 2 can be obtained by one of the two processes, either a process by the attached particle removal apparatus 5 or a process by the film surface processing apparatus 6 may be executed.

In order to positively remove dusts to be generated while the film surface is ground/polished for film formation, a nozzle for jetting out a gas or a dust sucking mechanism may be installed near at the position where the film surface is ground/polished.

If metal ultra fine particles are used, it is necessary to pay more attention to making a film denser than using ceramic ultra fine particles which are brittle. In this context, it may be effective in some case to press the surface of the deposited film 2*a* with a roller to planarize the film surface by utilizing plastic deformation of metal. In this case, this roller is installed by replacing the grinding/polishing roller 12.

The planarizing process of rolling or scraping, grinding or polishing or pressing the surface layer portion of a deposit of ultra fine particles supplied to the substrate, is executed each time the deposited film 2*a* of a single layer structure is formed by supplying ultra fine particles from the ultra fine particle supply apparatus to the substrate. A combination of a process of forming the deposited film of the single layer structure by a single supply of ultra fine particles and the planarizing process for the deposited film of the single layer structure may be performed a plurality of times. Alternatively, after a deposited film 2*a* of a multi-layer structure is formed by a plurality of supplies of ultra fine particles from the ultra fine particle supply apparatus, the planarizing process may be performed for the deposited film 2*a* of the multi-layer structure.

The former case of performing the planarizing process each time the deposited film of the single layer structure is formed, is effective for making the final film dense in its inner region.

Figure 2:
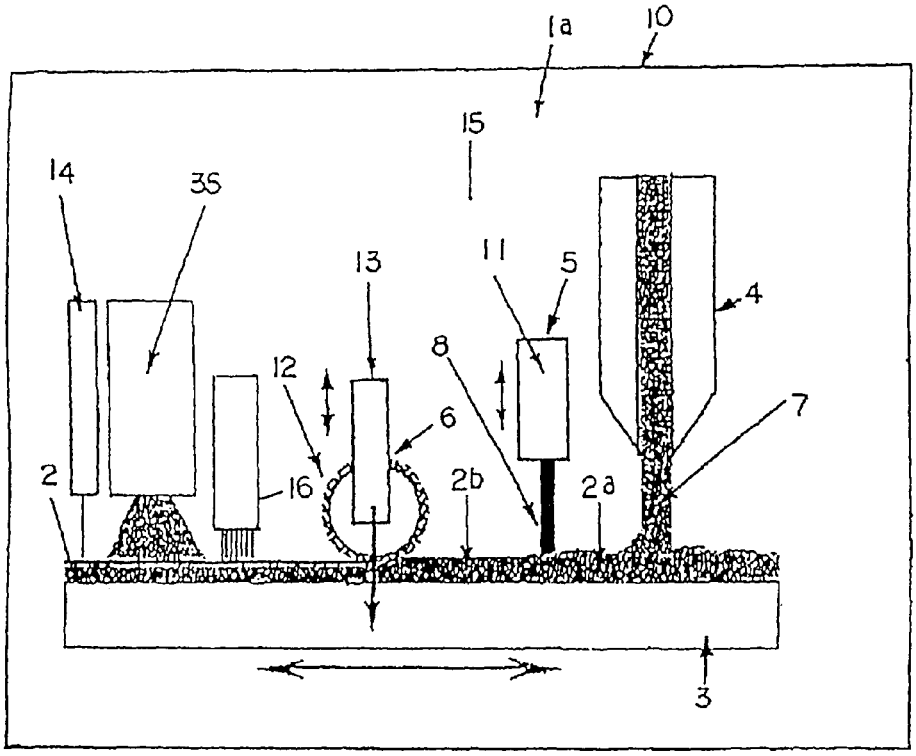
FIG. 2 is a schematic diagram showing the structure of a planarized ultra fine particle film forming apparatus according to another embodiment of the invention.

In the embodiment described above, in forming a ultra fine particle film, the planarizing process of rolling or scraping, grinding or polishing, or pressing the surface layer of a deposited film on the substrate is executed. The invention is applicable to the film forming method (refer to JP-A-10-208998) and the film forming method (refer to JP-A-11-117328). With the former method, ion beams, plasma or the like is applied to ultra fine particles as source material or to the film surface during deposition to activate the ultra fine particles or the film surface during deposition and bond at a low temperature the ultra fine particles together or the film surface and ultra fine particles. With the latter method, a mechanical impact force is applied to the deposited film to crush ultra fine particles and bond the ultra fine particles of the deposited film. In this case, as shown in FIG. 2, a planarized ultra fine particle film forming apparatus 1*a* is provided with a plasma ion beam generator apparatus 35. A film may be formed by applying ion beams, plasma or the like to ultra fine particles or to the film surface during deposition or a film may be formed through low temperature bonding of ultra fine particles by applying a mechanical impulse force which is generated: by accelerating ultra fine particles by an electrostatic field or gas transport and spraying them to and colliding them with ultra fine particles on the substrate; by using a brush or roller rotating at high speed, a pressure needle moving up and down at high speed, or a piston moving at high speed by explosion force; or by generating ultra sounds. Thereafter, the planarizing process of rolling or scraping, grinding or polishing, or pressing the surface layer portion of each of these films, is executed. Alternatively, a mechanical impact force loading apparatus 16 is used to load a mechanical impact force to ultra fine particles of a deposited film, a scraped film, or a ground/polished film to crush these ultra fine particles and bond them together, This mechanical impact force is applied to the deposited film: by accelerating ultra fine particles by an electrostatic field or gas transport and spraying them to and colliding them with ultra fine particles on the substrate; by using a brush or roller rotating at high speed, a pressure needle moving up and down at high speed, or a piston moving at high speed by explosion force; or by generating ultra sounds. If ultra fine particles of the deposited film are to be bonded by applying the mechanical impact force to the deposited film and crushing the ultra fine particles, the ultra fine particles may be processed beforehand so that they can be crushed easily by the mechanical impact force to be applied. This process may be a process of adjusting a preliminary baking temperature of ultra fine particles, a process of heating ultra fine particles prepared to have a particle diameter of about several tens nm and aggregating them to form secondary particles having a particle diameter of about 50 nm to/μm, or a process of forming cracks in ultra fine particles so as to make them easy to be crushed, by using for a long time period a breaker or crusher such as a ball mill, a jet mill, a vibration mill, an epicyclic mill and a bead mill.

As above, according to the invention, defective particles are removed to planarize the surface of a deposited film of ultra fine particles supplied from the nozzle, by rolling or scraping, grinding or polishing, or pressing the surface layer portion of the deposited film. If the film 2 is formed by pressing the deposited film, a pressure apparatus is used to press the deposited film 2*a*, the surface scraped film 2*b*, or the surface scraped film 2*b* after the grinding/polishing process. An example of the pressure apparatus is a pressure roller having a circumferential surface worked to have a mirror surface, in place of the grinding/polishing roller 12 shown in FIG. 1.

Figure 3:
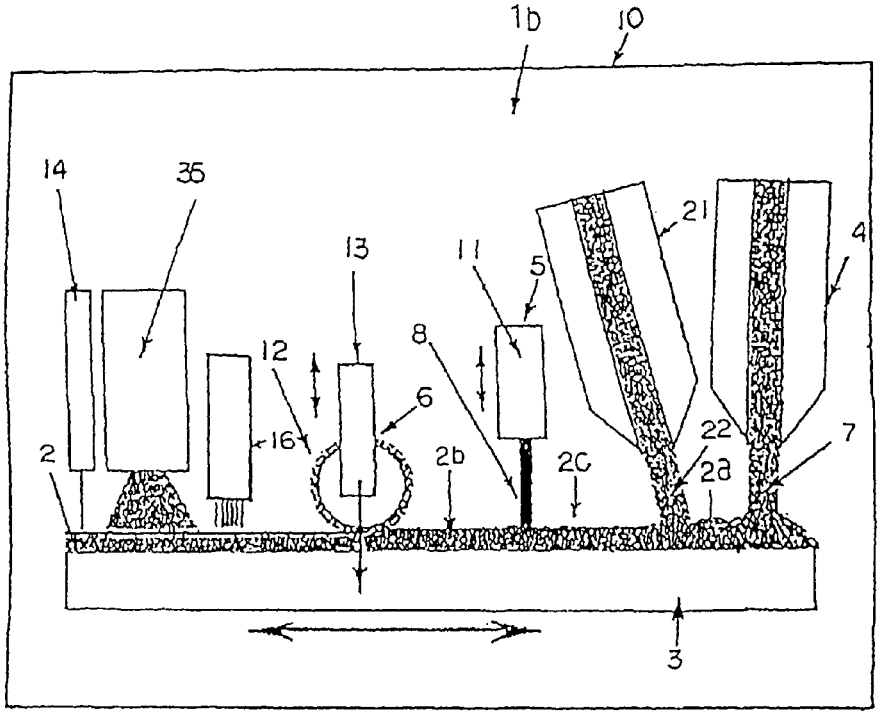
FIG. 3 is a schematic diagram showing the structure of a planarized ultra fine particle film forming apparatus according to still another embodiment of the invention.
Figure 4:
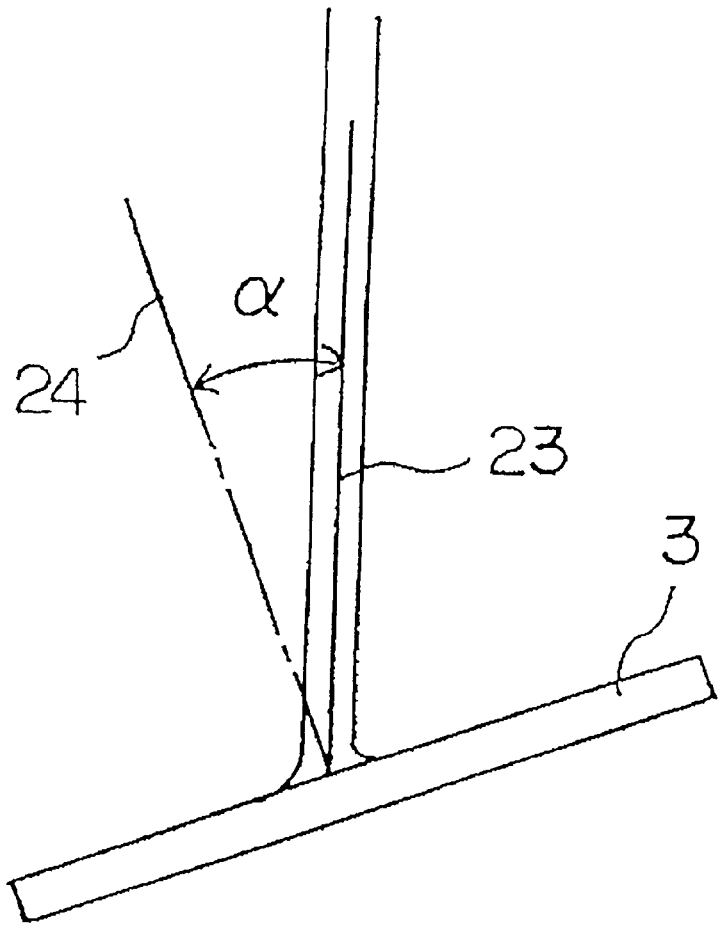
FIG. 4 is a schematic diagram showing an incidence angle of planarizing particles.
Figure 8:
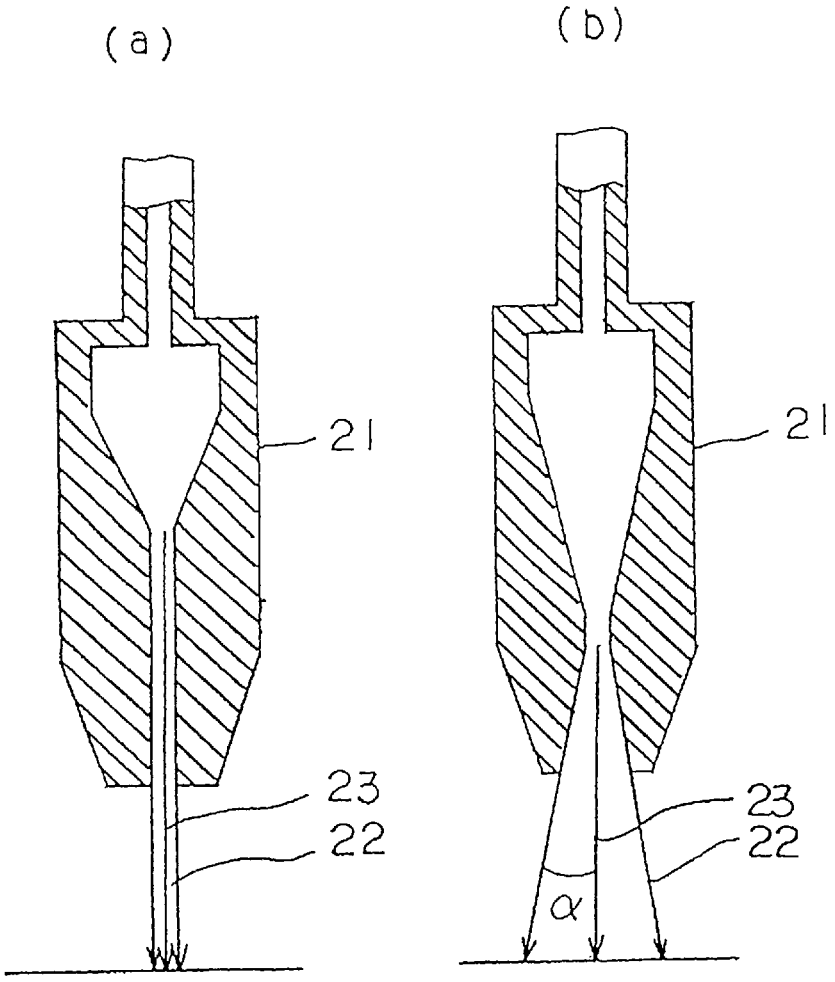
FIGS. 8 A and 8B are vertical cross sectional views of spray apparatus.
Figure 9:
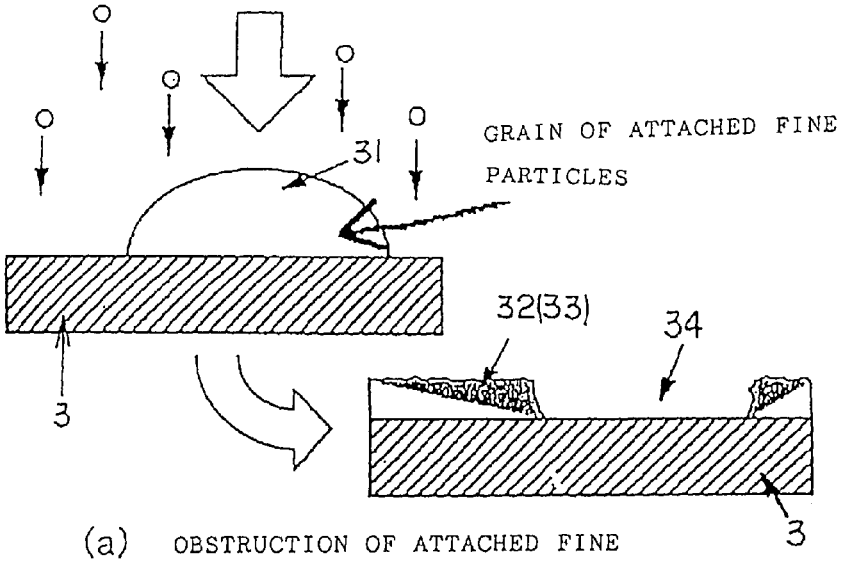
FIGS. 9A and 9B are cross sectional views showing deposited films.
Figure 9:
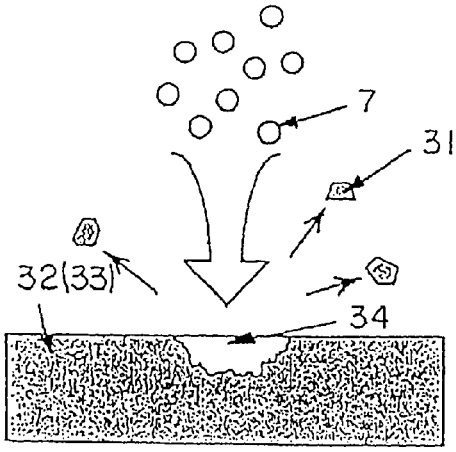
Figure 10:
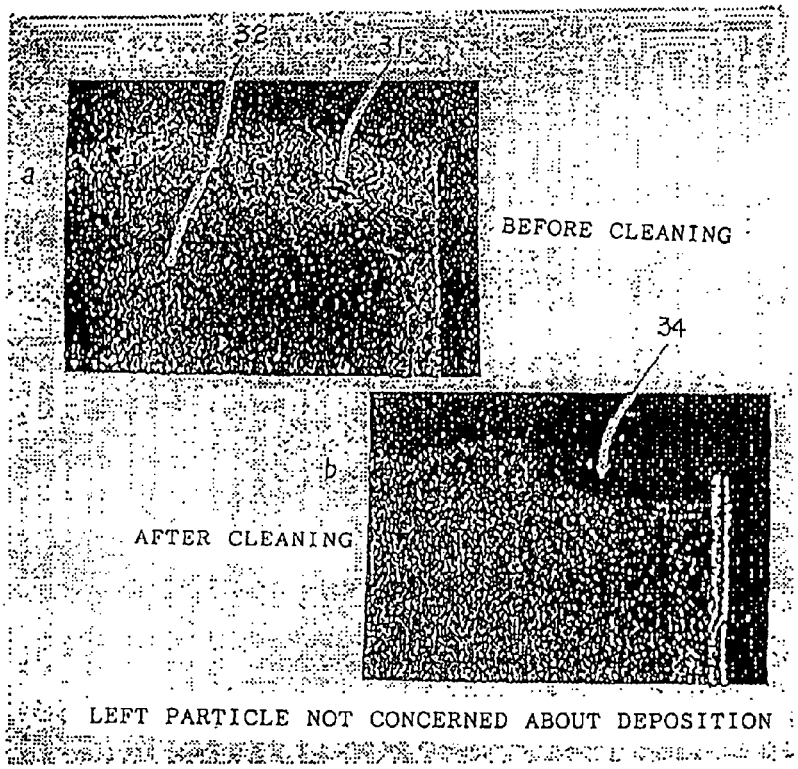
FIGS. 10A and 10B are microscopic photographs showing cross sectional views of deposited films.
Figure 11:
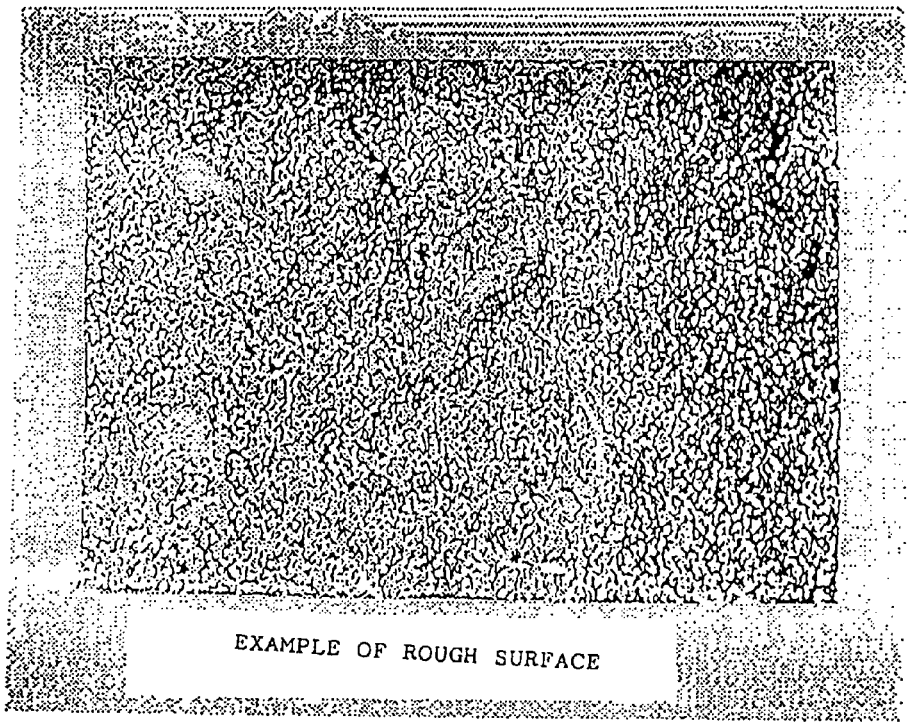
FIG. 11 is a microscopic photograph showing the surface of a film surface formed by conventional techniques.

FIG. 3 shows a planarized ultra fine particle film forming apparatus 1*b* according to another embodiment of the invention. A different point of the planarized ultra fine particle film forming apparatus 1*b* from the planarized ultra fine particle film forming apparatus 1 of the first embodiment resides in that a spray apparatus 21 is used as part of the planarizing apparatus 15. The spray apparatus 21 jets out planarizing fine particles 22 toward the deposited film 2*a* to grind and polish the surface of the deposited film 2*a* and form a planarized film 2*c*. The planarizing fine particles 22 are used for grinding and polishing the surface of the deposited film 2*a*. The planarizing fine particles 22 may be blown toward the substrate in a mixed state with the ultra fine particles 7, or blown toward the substrate by using the spray apparatus 21 separately from the ultra fine particles 7 which are supplied from the nozzle 4. In the apparatus shown in FIG. 3, the planarizing fine particles and ultra fine particles are blown separately. The spray apparatus 21 may be used in place of the attached particle removal apparatus 5 and film surface processing apparatus 6 of the planarized ultra fine particle film forming apparatus 1 of the first embodiment, or in combination with the attached particle removal apparatus 5 and film surface processing apparatus 6. As the spray apparatus 21, a nozzle or an electrostatic acceleration gun may be used. As shown in FIG. 4, the spray apparatus 21 is disposed so that planarizing fine particles 22 become obliquely incident upon the substrate in an incidence angle range of −60 degrees to −5 degrees or +5 degrees to +60 degrees between the central axis 23 of a jet flow and the normal 24 to the surface of the substrate 3. An example of the spray apparatus 21 to be used in such a case is shown in FIG. 8A. As shown in FIG. 7 A, the spray apparatus 21 may be disposed so that the planarizing fine particles jetted out from the spray apparatus 21 form a conical shape having an angle range of −60 degrees to −5 degrees or +5 degrees to +60 degrees about the center of a jet flow. An example of the spray apparatus 21 to be used in such a case is shown in FIG. 8B.

If the planarizing fine particles 22 and ultra fine particles 7 are made to have the same composition, it is possible to prevent foreign material from entering the film 2. It is preferable that the planarizing fine particles 22 have a particle diameter larger than that of the ultra fine particles 7. If the planarizing fine particles 22 have a rigidity higher than that of the ultra fine particles 7, the grinding/polishing effect can be enhanced.

Planarizing a ultra fine particle film by using such an apparatus is performed in the following manner. According to a thin film forming method of this invention, when ultra fine particles collide with the substrate, they are recombined together to form a thin or thick film at a low temperature. The planarizing process is performed to planarize the surface of a deposited film of ultra fine particles to thereby form a film excellent in density, uniformity, transparency and the like. In the planarizing process of planarizing the deposited film of ultra fine particles, planarizing fine particles having the grinding/polishing function are obliquely blown toward the surface of the deposited film to thereby grind and polish the surface and obtain a flat and smooth surface. Thereafter, the same process is repeated each time after new ultra fine particles are deposited on the flat and smooth surface to increase the film thickness. Furthermore, by making the planarizing fine particles and ultra fine particles have the same composition, it is possible to prevent foreign material from entering the film.

Figure 5:
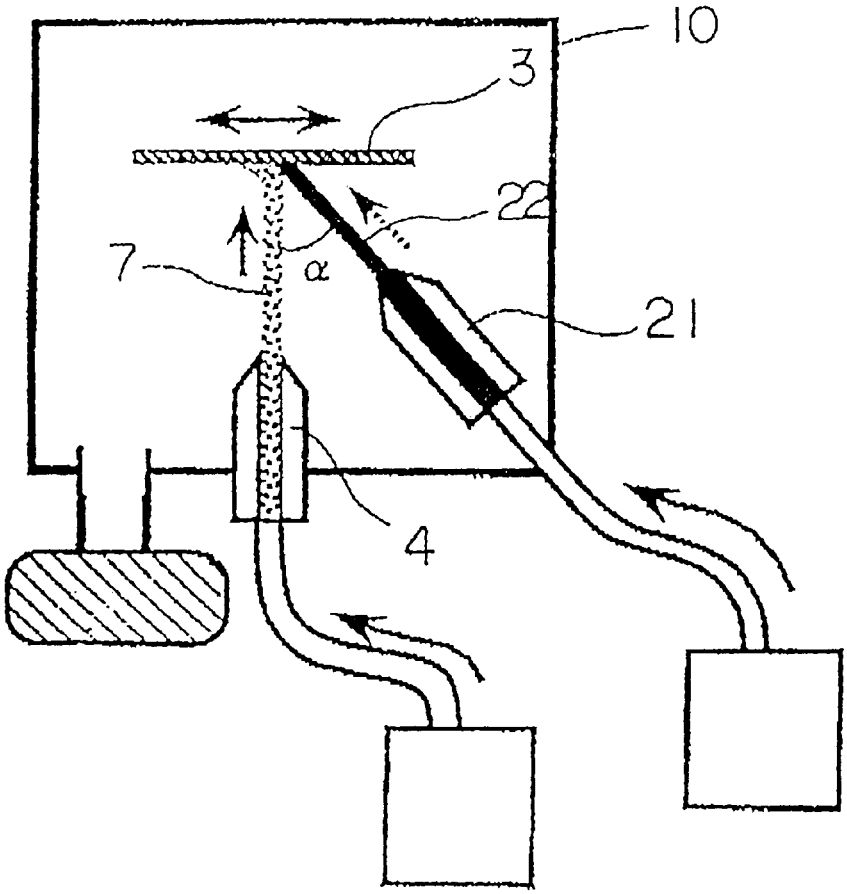
FIG. 5 is a schematic diagram showing an example of a spray apparatus for blowing ultra fine particles and planarizing particles.

An example of a spray or blowing method is illustrated in FIG. 5. As shown, ultra fine particles 7 are jetted out of the nozzle 4 and planarizing fine particles are jetted out of the spray apparatus 21, both to be applied to the same point on the substrate 3.

If a spray angle of planarizing fine particles 22 having the grinding/polishing function relative to the surface of the deposited film 2*a* is 0 degree (at a right angle to the substrate surface), although there is a grinding function, an impact function relative to the deposited film is greater so that the film is likely to have damages and the ground region becomes spatially irregular and discontinuous. It is therefore impossible to obtain a flat and smooth surface. In contrast, if planarizing fine particles having the grinding/polishing function are obliquely blown toward the substrate surface, the impact function relative to the deposited film becomes small and the grinding/polishing function relative to the deposited film becomes greater so that the surface of the deposited film is ground and polished spatially uniformly. It is therefore possible to obtain a flat and smooth surface. However, if the spray angle of planarizing fine particles having the grinding/polishing function relative to the surface of the deposited film becomes too large, the grinding/polishing function lowers considerably.

When the degree of the grinding/polishing effect and the damages of the surface of the deposited film are taken into consideration, it is preferable to set the spray angle of planarizing fine particles having the grinding/polishing function relative to the surface of the deposited film to the incidence angle range of −60 degrees to −5 degree or +5 degrees to +60 degrees relative to the substrate surface, although the optimum spray angle depends on the material qualities of ultra fine particles and planarizing fine particles. In blowing planarizing fine particles having the grinding/polishing function toward the surface of the deposited film, the fine particles having the grinding/polishing function may be mixed with gas and blown from a nozzle or they may be electrically charged and electrostatically accelerated and blown.

Figure 6:
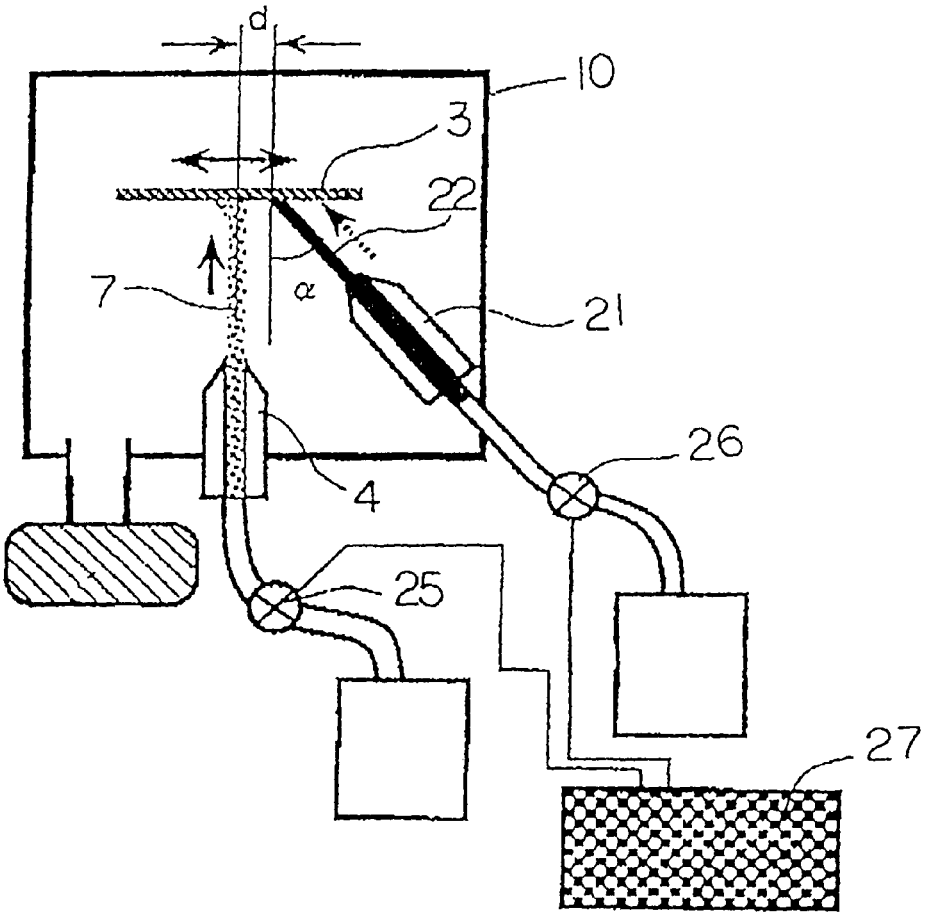
FIG. 6 is a schematic diagram showing another example of a spray apparatus for blowing ultra fine particles and planarizing particles.

In the embodiment illustrated in FIG. 5, if the ultra fine particles 7 and planarizing fine particles 22 are applied to the same position of the substrate 3, a flow of the ultra fine particles 7 for forming the deposited film 2*a* may be disturbed by a flow of the planarizing fine particles 22 so that a film cannot be formed stably depending upon film forming conditions. To avoid this, as shown in FIG. 6, the ultra fine particles 7 and planarizing fine particles 22 are applied to offset positions of the substrate 3, or flows of the ultra fine particles 7 and planarizing fine particles 22 may be separated in time or space by using valves 25 and 26 and a valve switching control apparatus 27, so that interference between two flows can be eliminated and a process of forming the deposited film 2*a* of ultra fine particles 7 and a planarizing process using planarizing fine particles 22 can be performed perfectly.

The planarizing fine particles having the grinding/polishing function may be blown toward the substrate by making them have a beam shape by using a nozzle or an electrostatic acceleration gun. Alternatively, as shown in FIG. 7 A, by controlling the jet conditions of the nozzle or electrostatic acceleration gun, the planarizing fine particles having the grinding/polishing function may be blown to form a conical shape having an angle range of −60 degrees to −5 degrees or +5 degrees to +60 degrees about the center of a jet flow output from the nozzle or electrostatic acceleration gun, with similar expected advantages.

Although this conical spray shown in FIG. 7A may be performed only for the planarizing fine particles 22, it may be performed for a mixture of the planarizing fine particles 22 and ultra fine particles 7. In this case, the nozzle 4 for blowing ultra fine particles 22 can be omitted. If mixed particles are used, it is effective for the grinding/polishing function that the diameter of the planarizing fine particles 22 is larger than that of the ultra fine particles 7, as described earlier. In this case, as shown in FIGS. 7B and 7C, the particle diameter distribution pattern of mixed particles have two peaks, one by the planarizing fine particles 22 and the other by the ultra fine particles 7.

Planarizing fine particles having the grinding/polishing function mixed with ultra fine particle for forming a film are jetted out toward a substrate or a deposited film from the same nozzle or electrostatic acceleration gun so that a flat and smooth film can be formed easily. As described in JP-A-11-117328, when a film of brittle ultra fine particles is formed, a mechanical impact force sufficient for crushing ultra fine particles is necessary. In this case, an apparatus (nozzle or electrostatic acceleration gun) for blowing ultra fine particles for forming a film and an apparatus (nozzle or electrostatic acceleration gun) for blowing planarizing fine particles having the grinding/polishing function are disposed separately. Each blowing apparatus is set so that the ultra fine particles for forming a film and the planarizing fine particles having the grinding/polishing function are blown in a beam shape. In accordance with the type of ultra fine particles for forming a film, the incidence angle relative to the substrate, a jet flow density, a jet-out time, timings and the like are controlled to form a flat and smooth film at high speed As appreciated from the foregoing description, the invention provides techniques of forming a ultra fine particle film which has ultra fine particles sufficiently bonded together, sufficient density, flat surface and uniform density. Techniques of this invention for forming a metal ultra fine particle film through pressing and planarizing are important in forming a laminated type piezoelectric actuator of a low drive voltage or the like. The laminated type piezoelectric actuator is made of a lamination of PZT as piezoelectric material and metal such as platinum and silver as electrode material. Since the film surface can be planarized, the film optical characteristics are improved. For example, a $TiO_2$ film is optically transparent.

Even if the supply amount of ultra fine particles for forming a film is not stable, a film thickness per one grinding/polishing process can be controlled precisely. It is therefore possible to uniformly and precisely control the thickness of a large area film to be formed by repeating this process.

What I claim are:

1. A layered body comprising a substrate and compact brittle material layers deposited on the substrate, wherein the compact brittle material layers are formed by spraying plastically deformable brittle material particles from a nozzle on the substrate, wherein the plastically deformable brittle material particles comprise a particle size of 0.7 μm-10 μm and are capable of being plastically deformed under an impact pressure of higher than a compressive strength of the plastically deformable brittle material particles, wherein the compact brittle material layers comprise a first compact brittle material layer and a second compact brittle material layer deposited on a smooth surface on its front side of the first compact brittle material layer, the first and second compact brittle material layers are formed by depositing the plastically deformable brittle material particles in order, the first compact brittle material layer comprises a compact particles assembly comprising plastically deformed brittle material particles, in which a gap between the plastically deformed brittle material particles is packed, the compact particles assembly is formed by re-bonding the plastically deformable brittle material particles, which comprises an active surface created on a surface of the plastically deformed particles by transposition of displacement or dislocation in a crystalline plane by plastically deformation to compose a polycrystalline providing a single crystalline with a diameter of less than 30 nm.

2. A method for producing the layered body of claim 1, comprising the steps of:

preparing the plastically deformable brittle material particles comprising the particle size of 0.7 μm-10 μm and capable of being plastically deformed under the impact pressure of higher than the compressive strength of the plastically deformable brittle material particles, forming a compact brittle material layer by spraying the plastically deformable brittle material particles on the substrate, and applying to the layer the impact pressure of higher than the compressive strength of the plastically deformable brittle material particles to compose the polycrystalline body composed of the re-bonded single crystalline particles having the particle size of less than 30 nm, by the dislocation of the crystalline plane or the transposition of the displacement.

* * * * *